US006356640B1

(12) United States Patent
Lin

(10) Patent No.: US 6,356,640 B1
(45) Date of Patent: Mar. 12, 2002

(54) DIRECTION ADJUSTING ARRANGEMENT FOR TWEETER

(76) Inventor: Steff Lin, 8Fl., No. 18, Lane 30, Kuo Hsing St., His Chih City, Taipei Hsien (TW)

( * ) Notice: Subject to any disclaimer, the term of this patent is extended or adjusted under 35 U.S.C. 154(b) by 0 days.

(21) Appl. No.: 09/855,501

(22) Filed: May 16, 2001

(51) Int. Cl.[7] ..... H04R 25/00

(52) U.S. Cl. ..... 381/182; 381/186; 381/387; 181/144

(58) Field of Search ..... 381/87, 89, 332, 381/335, 336, 182, 186, 386, 387, 395, FOR 151, FOR 165; 181/144, 145, 147, 153, 154, 199

(56) References Cited

U.S. PATENT DOCUMENTS 6,002,780 A * 12/1999 Espiritu ..... 381/182
6,095,278 A * 8/2000 Lin ..... 381/182
6,101,262 A * 8/2000 Haase et al. ..... 381/182

* cited by examiner

*Primary Examiner*—Huyen Le
(74) *Attorney, Agent, or Firm*—Bacon & Thomas, PLLC

(57) ABSTRACT

A direction adjusting arrangement for a tweeter mainly includes a round sleeve screwed to a base mounted at a center of a woofer of a loudspeaker and a ball portion provided at a rear end of the tweeter. The sleeve is formed at a lower inner end with a bowl-shaped socket into which the ball portion is movably received. A curved slide way is provided in the socket extended by a predetermined length from a top of the sleeve toward a bottom center of the socket. A projection is provided at middle point of one side of an outer wall surface of the ball portion to movably extend into the slide way. The ball portion could be turned in the socket with the projection guided by the slide way and be pivotally turned in the socket about the projection, so that the tweeter could be adjusted in its angular position relative to the woofer to face different directions.

1 Claim, 4 Drawing Sheets

DIRECTION ADJUSTING ARRANGEMENT FOR TWEETER

BACKGROUND OF THE INVENTION

The present invention relates to a direction-adjustable tweeter, and more particularly to a direction adjusting arrangement for a tweeter to turn at different angles to enable emission of sound toward different directions.

Typically, a loudspeaker includes at least a squawker and a woofer to provide two different types of compass. In order to provide a full compass, a tweeter is further provided at a center of the woofer. Conventionally, the tweeter is fixedly mounted at the center of the woofer. Thus, it is necessary to consider a desired sound transmitting direction before mounting the tweeter. It is very troublesome to do so and the tweeter in a fixed position does not provide good sounding effects. For a loudspeaker mounted in a car, the limited mounting space and position further reduces the function of the tweeter. It is therefore desirable to develop a direction-adjustable tweeter to solve the above-mentioned problem.

SUMMARY OF THE INVENTION

A primary object of the present invention is to provide a direction adjusting arrangement for tweeter mounted to a center of a woofer of a loudspeaker. The arrangement mainly includes a round sleeve screwed to a base mounted at a center of the woofer and a ball portion provided at a rear end of the tweeter. The sleeve is formed at a lower inner end with a bowl-shaped socket into which the ball portion is movably received. A curved slide way is provided in the socket extended by a predetermined length from a top of the sleeve toward a bottom center of the socket. A projection is provided at middle point of one side of an outer wall surface of the ball portion to extend into and move along the slide way. The ball portion could be turned in the socket with the projection guided by the slide way or be pivotally turned in the socket about the projection, so that the tweeter could be adjusted in its angular position relative to the woofer to face different directions.

Another object of the present invention is to provide the above direction adjusting arrangement for tweeter in which the projection provided on the ball portion engages with the slide way provided on the socket to restrict the tweeter to pivotally turn only within a predetermined range and thereby prevents wires of the tweeter from breaking due to an overturned tweeter.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
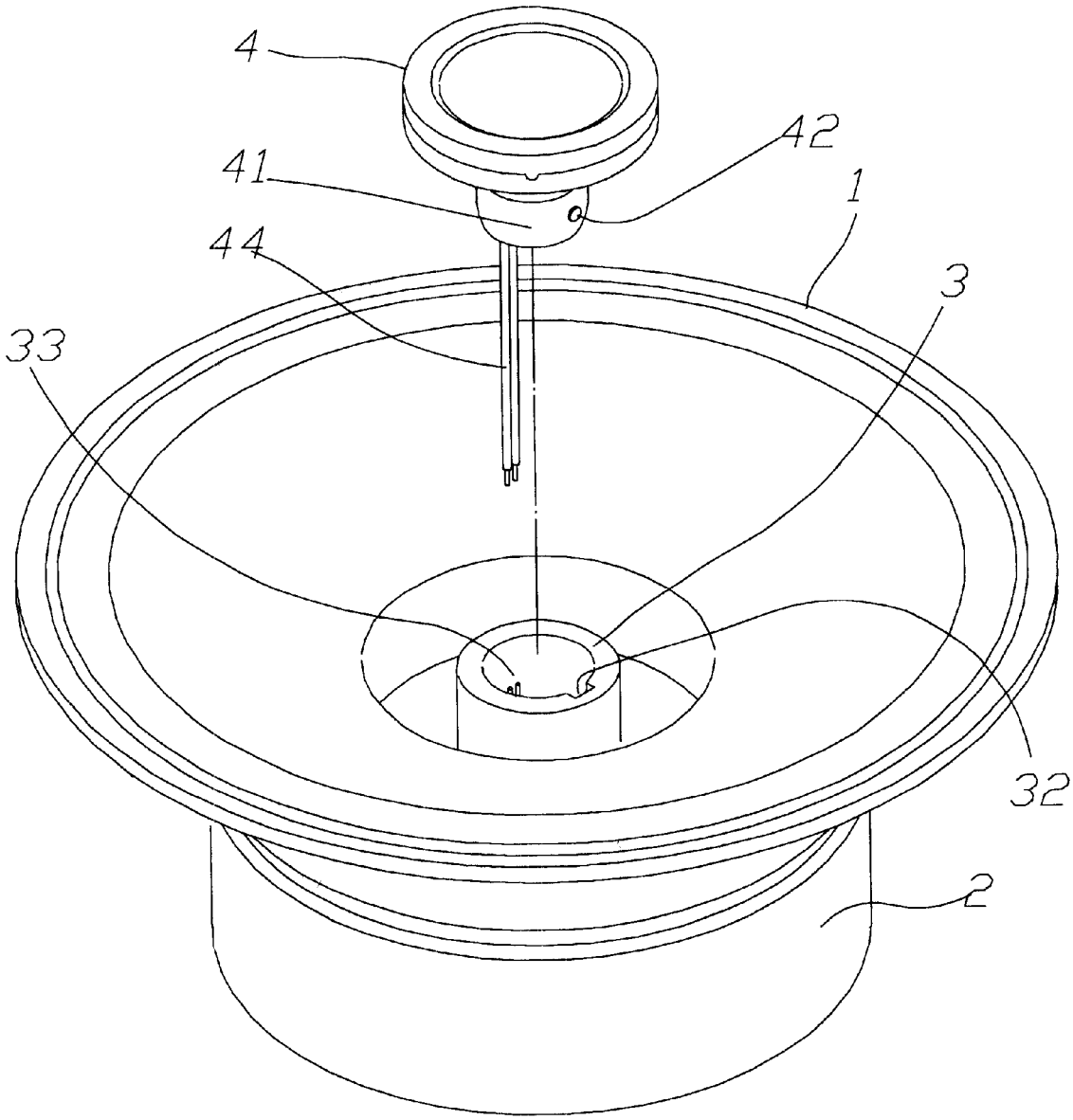
FIG. 1 is an exploded perspective view showing the direction adjusting arrangement for tweeter according to the present invention.
Figure 2:
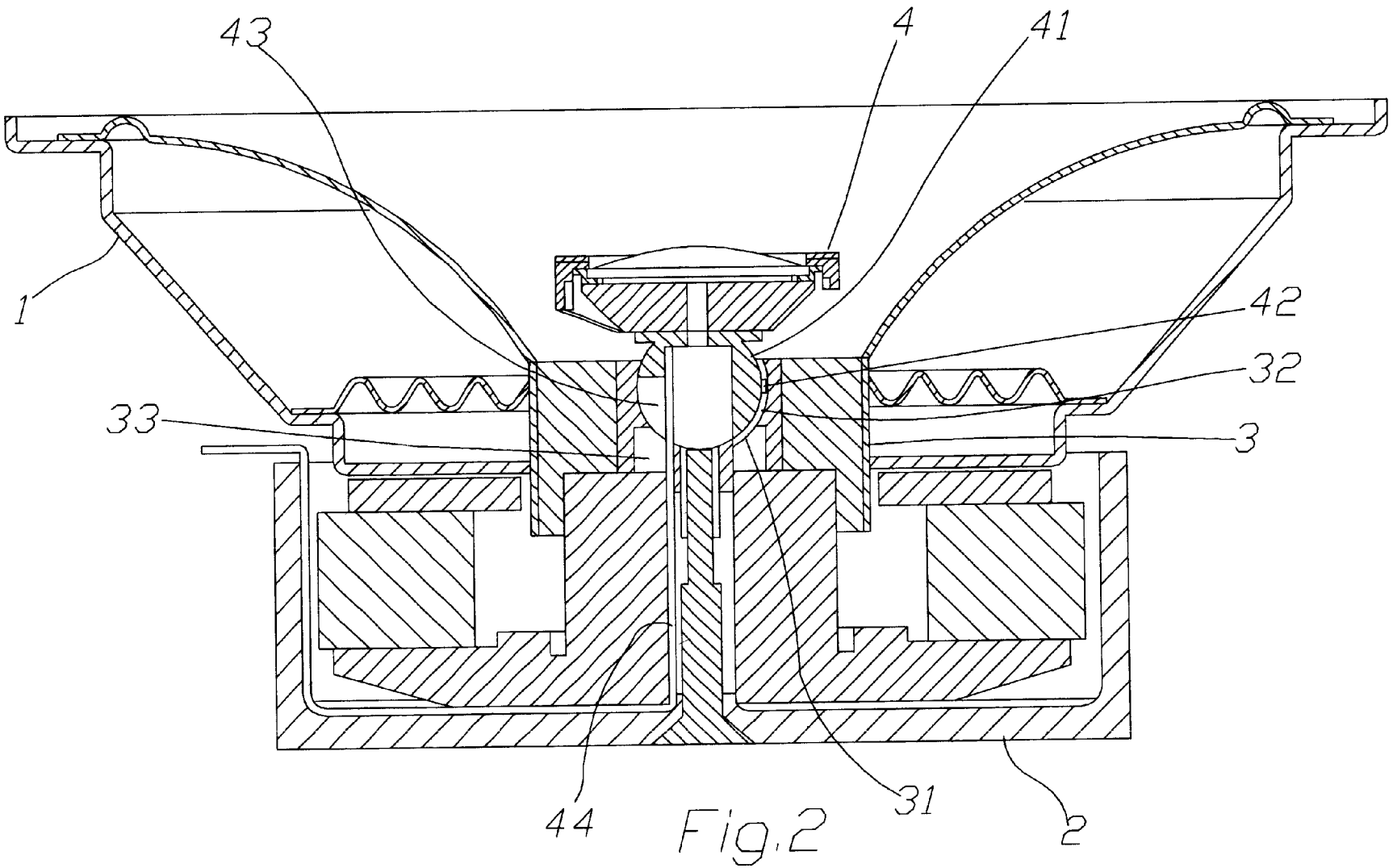
FIG. 2 is an assembled sectional view of FIG. 1.

Please refer to FIGS. 1 and 2 that are exploded perspective and assembled sectional views, respectively, showing a direction adjusting arrangement for tweeter according to the present invention. As shown, a conventional loudspeaker includes a woofer 1 and a base 2 mounted to a center of the woofer 1. The direction adjusting arrangement for tweeter according to the present invention mainly includes a round sleeve 3 screwed to the base 2 in order to locate at a center of the woofer 1. A lower inner end of the sleeve 3 is formed of a substantially bowl-shaped socket 31. A curved slide way 32 is provided on an inner wall surface of the sleeve 3 to extend by a predetermined length from a top of the sleeve 3 toward a bottom center of the bowl-shaped socket 31. The socket 31 is provided at a position opposite to the slide way 32 with an opening 33.

The direction adjusting arrangement for tweeter according to the present invention also includes a ball portion 41 provided at a rear end of a tweeter 4. The ball portion 41 is provided at middle point of one side of an outer wall surface thereof with a projection 42, and at a position opposite to the projection 42 with an opening 43, such that the ball portion 41 of the tweeter 4 is adapted to fitly locate in the bowl-shaped socket 31 of the sleeve 3 with the projection 42 extended into and movable along the slide way 32. Wires 44 of the tweeter 4 are guided to sequentially pass through the opening 43, the opening 33, and the base 2 to connect to an external power supply for transmission of sound signals.

After the tweeter 4 is mounted to the center of the woofer 1 by fitting the ball portion 41 into the socket 31 and the projection 42 in the slide way 32, the tweeter 4 may be pivotally turned about the projection 42 relative to the woofer 1 to face toward different directions.

Figure 3A:
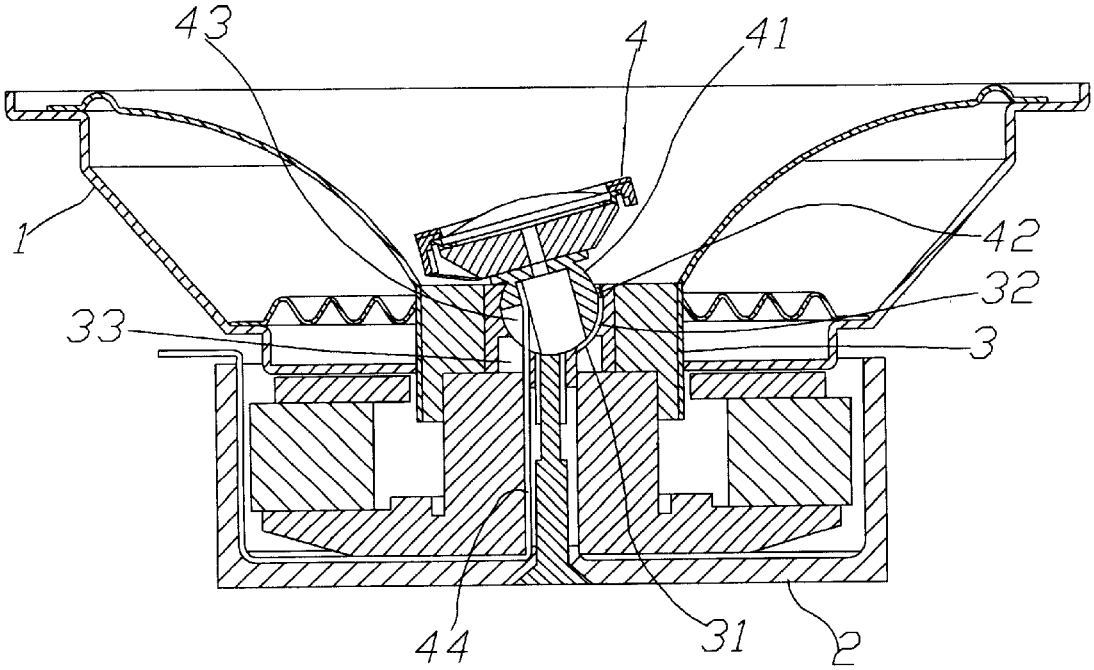
FIGS. 3A and 3B are sectional views showing a tweeter could be pivotally turned toward different directions with the arrangement of the present invention.
Figure 3B:
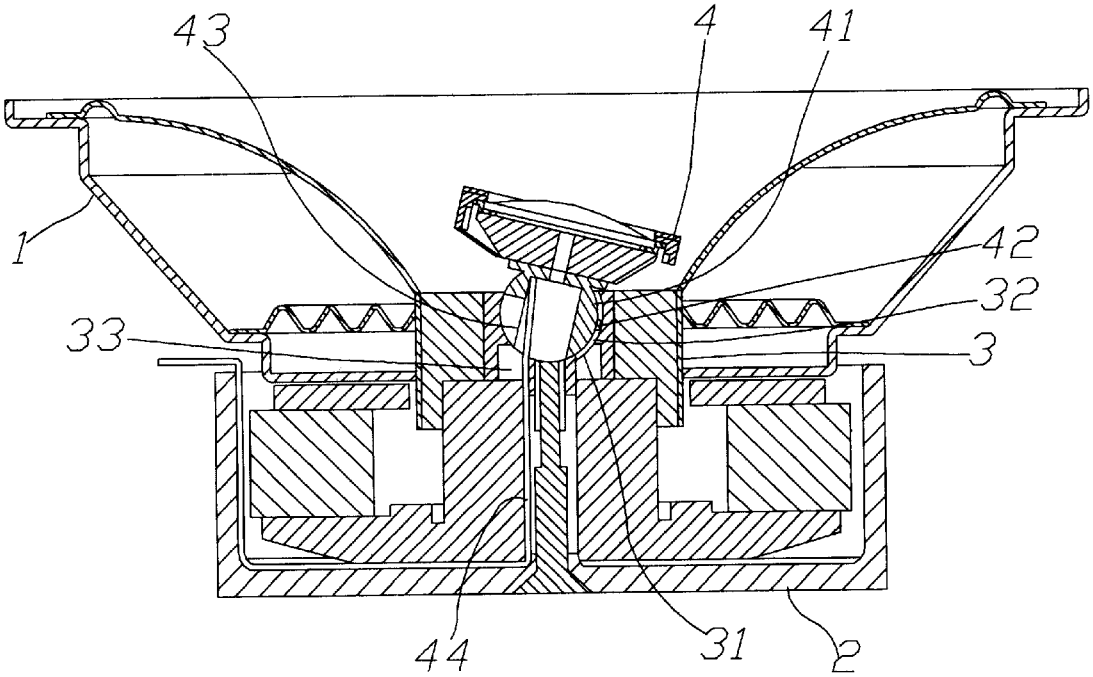

Please refer to FIGS. 3A and 3B. When the ball portion 41 of the tweeter 4 is caused to move in the socket 31 with the projection 42 guided by the slide way 32, the tweeter 4 could be pivotally turned relative to the woofer 1 to face leftward or rightward. Moreover, as mentioned above, the projection 42 is provided at middle point of one side of the ball portion 41 to extend into the slide way 32. This position allows the ball portion 41 to be pivotally turned about the projection 42 in the socket 31, allowing the tweeter 4 to be pivotally turned forward and backward relative to the woofer 1. In brief, with the arrangement of the present invention, the ball portion 41 may be forward, backward, rightward or leftward turned in the socket 31 to allow the tweeter 4 to face different direction as desired. And, since the projection 42 is restricted within the slide way 32, the tweeter 4 is prevented from being overly turned to cause broken wires 44.

Figure 4A:
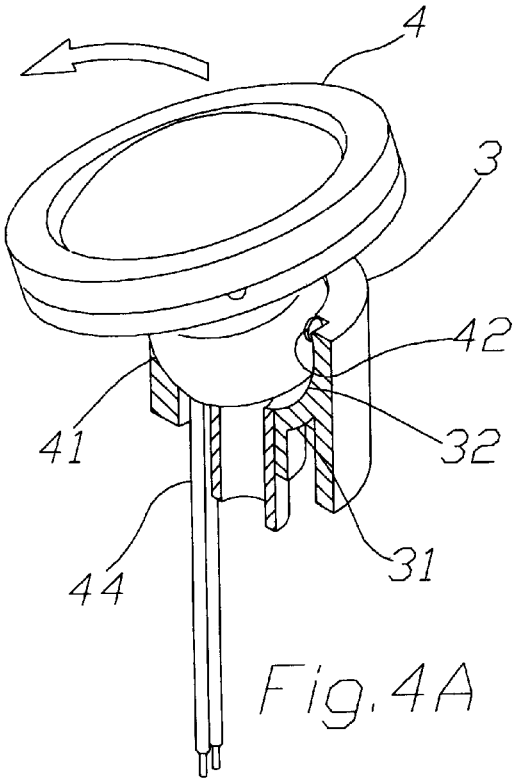
FIGS. 4A to 4D are perspective views showing the direction adjusting arrangement of the present invention allows the tweeter to pivotally turn toward different directions.
Figure 4B:
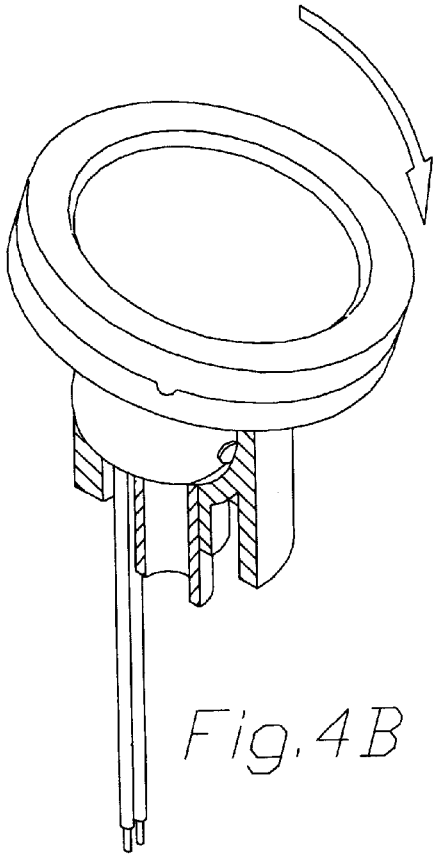
Figure 4C:
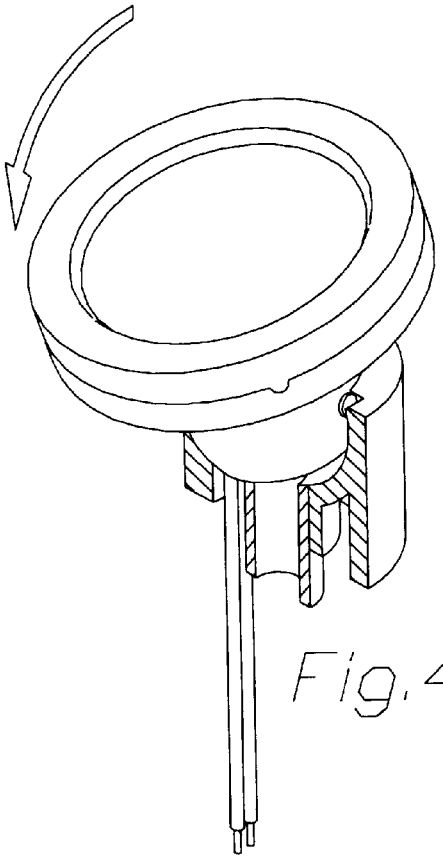
Figure 4D:
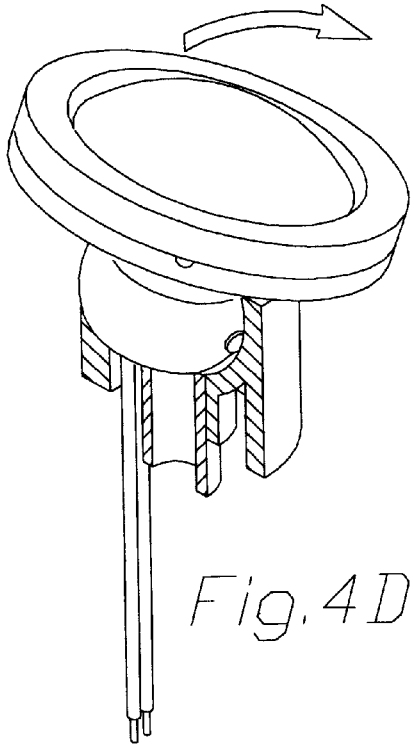

FIGS. 4A and 4B show that the ball portion 41 of the tweeter 4 is leftward or rightward moved in the socket 31 with the projection 42 slidably located in the slide way 32, preventing the wires 44 from being overly pulled and damaged due to an overturned ball portion 41. FIGS. 4C and 4D show that the ball portion 41 of the tweeter 4 could be further forward or backward moved in the socket 31 about the projection 42 after the tweeter 4 has been leftward or rightward turned to a desired angular position. That is, the tweeter 4 could be turned relative to the woofer 1 to different angular positions to provide enhanced sound effects.

Briefly speaking, the present invention includes a ball portion provided at a rear end of a tweeter and a bowl-shaped socket fixed to a center of a woofer of a loudspeaker for movably receiving the ball portion of the tweeter therein, such that the tweeter could be pivotally turned to different angular positions relative to the woofer, enabling the loudspeaker to provide better sound effects.

What is claimed is:

1. A direction adjusting arrangement for a tweeter to be mounted to a center of a woofer of a loudspeaker, comprising:

a round sleeve screwed to a base in said loudspeaker mounted at the center of said woofer, said sleeve being formed at a lower inner end with a bowl-shaped socket; and a ball portion provided at a rear end of said tweeter and being fitly received in said bowl-shaped socket, such that said ball portion is pivotally turnable in said socket for said tweeter to face different directions;

said direction adjusting arrangement for a tweeter being characterized in that said sleeve is provided at an inner wall surface with a curved slide way extended by a predetermined length from a top of said sleeve toward a bottom center of said socket, and at a position opposite to said slide way with a first opening, and that said ball portion is provided at middle point of one side of an outer wall surface with a projection, and at a position opposite to said projection with a second opening;

whereby when said ball portion is received in said socket, said projection extends into said slide way to fitly and movably locate therein and wires of said tweeter are sequentially extended through said second and said first openings to connect to an external power supply; and whereby said tweeter could be adjusted to face different directions by causing said ball portion to move in said socket with said projection guided by said slide way and causing said ball portion to pivotally turn about said projection in said socket, and whereby said projection fitly located in said slide way prevents said ball portion from being overly turned relative to said socket to cause damage to said wires.

* * * * *